US005529305A

United States Patent [19]

Wu

[11] Patent Number: 5,529,305

[45] Date of Patent: Jun. 25, 1996

[54] GOLF PRACTICE DEVICE

[76] Inventor: Derek T. Wu, 11310 SW. 131 Ave., Miami, Fla. 33186

[21] Appl. No.: 488,552

[22] Filed: Jun. 5, 1995

[51] Int. Cl.[6] ..... A63B 69/36

[52] U.S. Cl. ..... 473/272; 473/273

[58] Field of Search ..... 273/187 R, 187 A, 273/187 B; 434/252

[56] References Cited

U.S. PATENT DOCUMENTS

| | | | |
|---|---|---|---|
| 1,208,995 | 12/1916 | Lyon | 273/187 R |
| 3,041,075 | 6/1962 | Taylor | 273/187 R |
| 4,647,048 | 3/1987 | Welch | 273/187 R |
| 5,401,029 | 3/1995 | Ivancevich | 273/187 R |
| 5,411,266 | 5/1995 | Guthry | 273/187 R |

*Primary Examiner*—George J. Marlo

[57] ABSTRACT

The golf practice device includes, on the one hand, a triangular-shaped frame with adjustable side members and a telescoping base member, and, on the other hand, a flat disk with angular graduations and an extending rod with a linear array of slots; the disk and rod both being connected to the apex of the triangular frame. The frame serves as a feet positioning means to aid the beginner golfer in determining his or her optimal golf stance. The extending rod serves as a tee positioning means to aid said golfer in deterimining the most effective putting and driving distances between the golfer and the ball.

2 Claims, 3 Drawing Sheets

GOLF PRACTICE DEVICE

BACKGROUND OF THE INVENTION

The present invention relates to a training device for practicing golf skills. More specifically, the present invention relates to a training device used in learning and practicing putting and driving techniques by the beginner golfer.

DESCRIPTION OF RELATED ART

Many training devices for golf rely on video taping of the beginner's swing and the comparing of such swing with an ideal swing. The beginner is also given general directions for the placement of the feet and stance with respect to the ball.

SUMMARY OF THE INVENTION

It is an object of the present invention to help a beginner golfer, whether child or adult, find his optimal golf stance, as well as the most effective putting and driving distances between the player and the ball.

A further object of the invention is to provide such a device which is of simple, inexpensive construction.

Finally, another object is to provide such a device that is both lightweight as well as collapsible into a more compact form, so that the device may fit inside of a golf bag for quick and convenient transportation.

Broadly, the invention contemplates a training device having a golfer's feet positioning means cooperating with tee positioning means to guide the trainee to properly address the ball. Both means are adjustable so that the trainee can experiment to obtain the optimal positions.

According to a more detailed aspect of the invention, the foregoing objects can be accomplished by providing a training device that includes three elongated members pivotably connected to form an isosceles triangular frame. The base member is telescoping. The other two members are accordingly of the same length and are joined to form the apex of the triangle. To this apex is rotatably attached an angularly graduated disk which serves as a direction indicator. Pivotably connected to the graduated disk is another elongated member which is provided with notches for locating the placement of a tee.

Other objects, the features and advantages of the invention will be apparent from the following detailed description when read with the accompanying drawing.

DETAILED DESCRIPTION OF THE DRAWINGS

Figure 1:
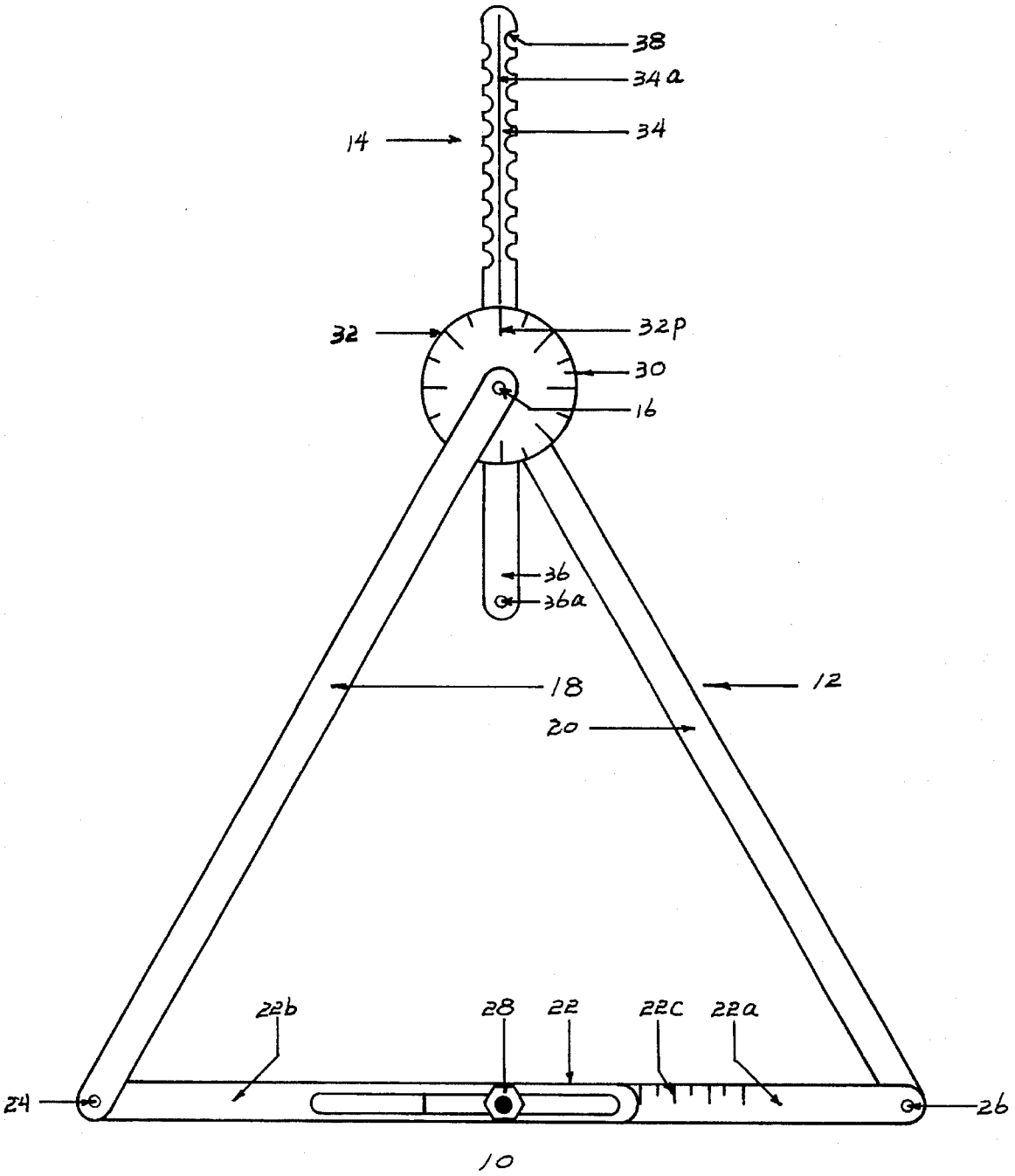
FIG. 1 shows a top elevation of a golf practice device in accordance with the present invention.
Figure 2:
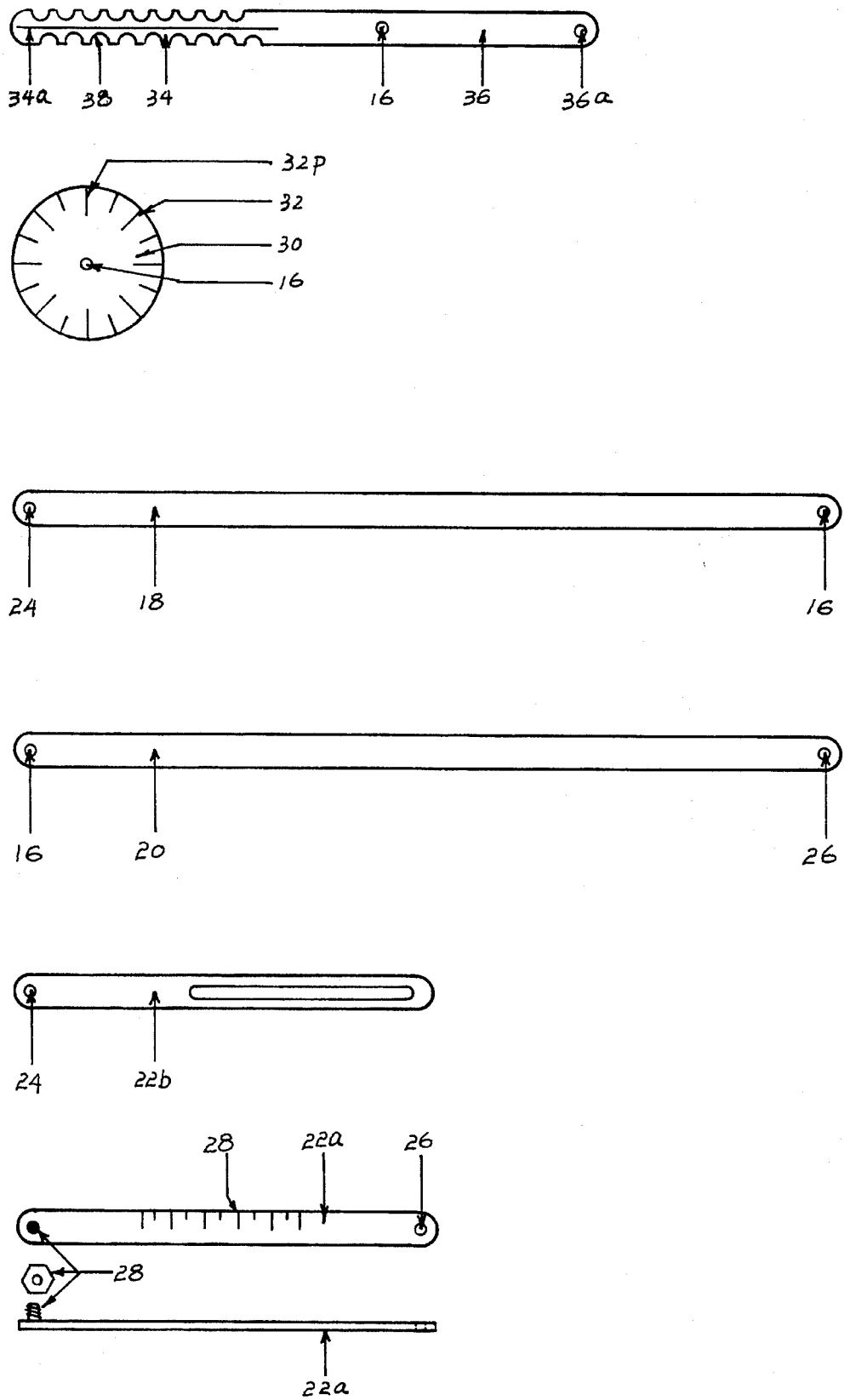
FIG. 2 is an exploded view of the elements of the device of FIG. 1.
Figure 3:
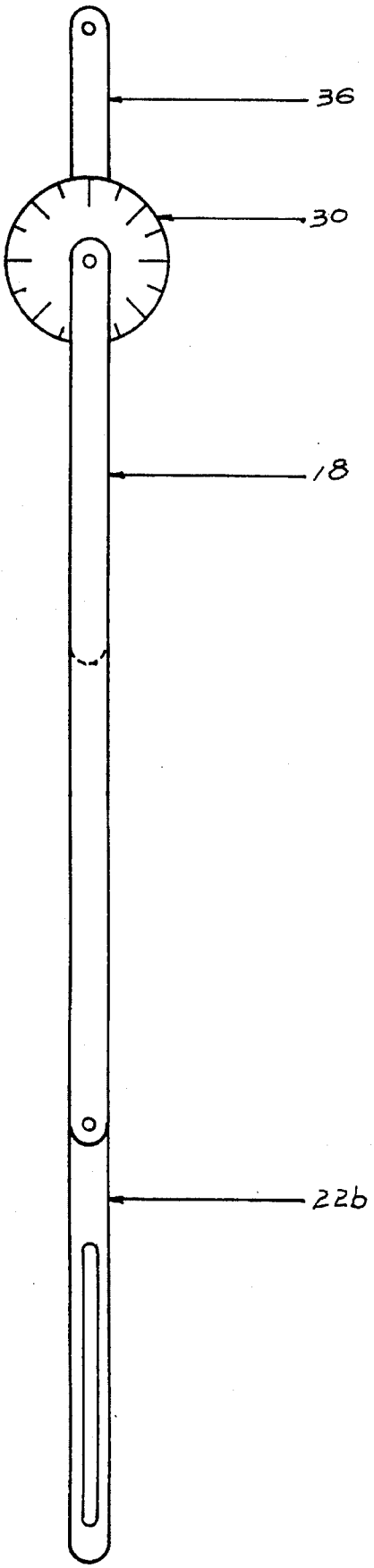
FIG. 3 shows a top elevation of the device of FIG. 1 folded into its compact form.

In FIG. 1, there is shown the training device 10 having a feet positioner 12 and a tee positioner 14. The positioners 12 and 14 are cooperatively connected at hole 16 with an eyelet. The feet positioner 12 includes equilength members 18 and 20 and a telescoping base member 22. One end of each of the members 18 and 20 is pivotably connected to hole 16 to form the apex of an isosceles triangle. The other ends thereof are pivotably connected through the agency of eyelets 24 and 26 to the respective ends of telescoping member 22. Thus, the members 18, 20, and 22 form an isosceles triangular-shaped frame with a variable length base. The telescoping member 22 can be two slotted rods **22*a* and 22*b* which slide over each other while being held together by a bolt and nut arrangement 28. Rod 22*a* is provided with indices 22*c* for indicating the distance between the eyelets 24 and 26**.

The tee positioner 14 includes: the flat disk 30 having a radially extending rod 34 and angularly displaced index graduations 32, hereinafter more fully explained, which is pivotably connected to eyelet 16. One end of rod 34 is arm 36 which has a hole **36*a* for accepting an anchoring device such as a tee. The other end is provided with a linear array of slots 38** for locating the tee that is to be used with the golf ball.

In use, the trainee places this training device 10 on the ground and stands so that the base of the triangular frame with the telescoping member 22 is nearest the trainee. He should then determine his optimal golf stance position. To do so, his feet should be placed approximately should-width apart. The trainee can then extend or contract the telescoping member 22 until its length is approximately equal to the distance between his feet. This length can then be maintained by locking the two sliding pieces **22*a* and 22*b* together by tightening the nut and bolt arrangement 28. Next, the two base angles 24 and 26 of the triangular frame each should lie just about opposite each of the player's feet. Then, the entire frame can be stabilized and locked into place by driving a tee through each of the eyelets 24 and 26** and then into the ground. Finally, if necessary, the apex of the triangle can be locked into place using another tee.

Regardless of how the length of the telescoping member 22 is adjusted, the trainee is always able to find the midpoint of the base of the triangle by rotating rod 34 until it projects perpendicular to the base of the triangle (i.e. telescoping member 22). This automatically follows from the geometry of an isosceles triangle.

It should be noted that since the telescoping member is marked with indices **22*c*, it is easy for a trainee to compare different golf stances to find the best one for himself and thereafter remember it. Once the stance position has been established, the placing of the tee follows. Normally, the tee is placed on a line that is equidistant from the feet. With the rod 34 in the aforesaid perpendicular position, such line is established and a tee is temporarily set in hole 36*a*. The positioning of rod 34 is as follows. Arm 36 of disk 30 is aligned perpendicular to the rods 22 as explained above. Then, disk 30 is rotated such that a vertical index 32*p* is aligned colinearly with the axial groove 34*a* on rod 34. The actual tee is placed in one of the slots 38. Which side of the rod 34 the tee is placed is determined by the handedness of the trainee (e.g. right-handed trainees should use the slots 38 on the right edge of rod 34). Which slot along the length of the rod 34 is determined by the height and the arm length of the trainee. Such slot is usually determined emperically. Generally, the taller the golfer, the further the slot from the apex. Once the actual tee is in place, the previous anchoring tee is removed from hole 36*a*, the rod 34** is rotated out of the way and into a horizontal position, and then the golfer can drive the ball.

Since there may be variations in golfer's swings, provision is made to rotate rod 34 with respect to the perpendicular and to the disk 30, which is marked with such perpendicular position **32*p*** so that various deviations from the normal midpoint can be tried. If one such deviation from the perpendicular proves more effective, it can be remembered and reused.

Thus, there has been shown an improved training device which assists in the positioning of the feet of the golfer and, at the same time, the positioning of the tee.

I claim:

1. A golf training device comprising:

a feet positioning means, said feet positioning means comprising first and second equilength rods and a telescoping rod, each of said rods having first and second ends, first pin means for pivotably interconnecting a first end of each of said first and second rods to form the apex of an isosceles triangle; second pin means for pivotably interconnecting the second end of said first equilength rod to a first end of said telescoping rod, third pin means for pivotably interconnecting the second end of said second equilength rod to the second end of said telescoping rod so that said telescoping rod defines the base of the isosceles triangle, and said second and third pin means indicating the positions of a golfer's feet, releasable locking means for locking said telescoping rod to lengths defining the distances between a golfer's feet for desired stances; and tee positioning means operatively connected to the apex-defining interconnection of said first and second equilength rods, said tee positioning means comprising an elongated rod rotatably connected at an intermediate point thereof to said first and second equilength rods through the agency of said first pin means, said intermediate point being such that a major portion of said elongated rod extends from the apex-defining interconnection into a region external to the region defined by said isosceles triangle and the remaining portion extends within the region defined by said isosceles triangle, locating means included in said major portion for locating the position of a tee, and a tee-accepting opening in said remaining portion for temporarily fixing the rotational orientation of said further rod.

2. The golf training device of claim 1 wherein said locating means includes a plurality of notches extending longitudinally along an edge of said major portion for locating a tee.

* * * * *